US006143422A

United States Patent [19]

Nagai et al.

[11] Patent Number: 6,143,422

[45] Date of Patent: Nov. 7, 2000

[54] SURFACE-TREATED STEEL SHEET HAVING IMPROVED CORROSION RESISTANCE AFTER FORMING

[75] Inventors: Hiroyuki Nagai; Yoshihiro Kawanishi; Eiji Kajiyama; Hiroyuki Kashiwagi; Shinichi Tsuchiya, all of Kashima, Japan

[73] Assignee: Sumitomo Metal Industries, Ltd., Osaka, Japan

[21] Appl. No.: 09/018,950

[22] Filed: Feb. 5, 1998

Related U.S. Application Data

[63] Continuation of application No. PCT/JP96/01537, Jun. 6, 1996.

[51] Int. Cl.[7] ..... B32B 15/00

[52] U.S. Cl. ..... 428/615; 428/659; 428/632; 428/626; 428/223; 428/935

[58] Field of Search ..... 428/612, 659, 428/632, 626, 223, 935

[56] References Cited

U.S. PATENT DOCUMENTS

| | | | |
|---|---|---|---|
| 4,548,868 | 10/1985 | Yonezawa et al. | 428/446 |
| 4,707,415 | 11/1987 | Ikeda et al. | 428/621 |
| 4,940,639 | 7/1990 | Ohshima et al. | 428/659 |
| 5,330,850 | 7/1994 | Suzuki et al. | 428/623 |
| 5,422,192 | 6/1995 | Takahashi et al. | 428/632 |
| 5,827,618 | 10/1998 | Oyagi et al. | 428/621 |
| 5,932,359 | 8/1999 | Nagai et al. | 428/621 |

FOREIGN PATENT DOCUMENTS

| | | |
|---|---|---|
| 58-45396 | 3/1983 | Japan . |
| 59-93884 | 5/1984 | Japan . |
| 61-30683 | 2/1986 | Japan . |
| 62-297490 | 12/1987 | Japan . |
| 3-219086 | 9/1991 | Japan . |
| 4-337099 | 11/1992 | Japan . |
| 5-25679 | 2/1993 | Japan . |
| 5-51761 | 3/1993 | Japan . |
| 5-106058 | 4/1993 | Japan . |
| 8-60175 | 3/1996 | Japan . |
| WO96/17979 | 6/1996 | WIPO . |

OTHER PUBLICATIONS

"*Corrosion Mechanism of Zn–Ni Alloy Plating*", H. Tsuji et al., (Oct. 10, 1982), The 66$^{th}$ Scientific Lecture Summaries by Metal Surface Technology Association, Japan, p. 144–145.

*Primary Examiner*—Deborah Jones
*Assistant Examiner*—Jason Resnick
*Attorney, Agent, or Firm*—Burns, Doane, Swecker & Mathis, LLP

[57] ABSTRACT

A material which can be improved in its resistance to corrosion caused by alcohol-containing fuels after formation without detriment to weldability and without any substantial cost increase is developed.

Constitution

A chromate film is applied to a Zn—X alloy electroplating layer, in which X is one or more of Ni: 3–18 wt %, Co: 0.02–3 wt %, Mn: 25–45 wt %, or Cr: 8–20 wt %. The Zn—Ni alloy plating layer underlying the chromate film has cracks with a density of 1000–150000 in terms of the number of plated regions surrounded by cracks in a 1 mm×1 mm visual field, with cracks having a maximum width of 0.5 μm or less comprising 90% or more of the total number of the cracks, and with cracks having a depth of 80% or more of the thickness of the plating layer comprising 80% or more of the total number of the cracks.

12 Claims, 3 Drawing Sheets

SURFACE-TREATED STEEL SHEET HAVING IMPROVED CORROSION RESISTANCE AFTER FORMING

This application is a continuation of Application No. PCT/JP96/01537, filed in Japan on Jun. 6, 1996, and which designates the United States of America.

TECHNICAL FIELD

The present invention relates to a surface-treated steel sheet having improved corrosion resistance after forming, and more particularly to a surface treated steel sheet which exhibits a high level of resistance to corrosion caused by fuels such as gasoline and gasohol, and which is suitable for making fuel tanks of vehicles such as automobiles and motorcycles, and kerosene tanks for use in oil stoves, boilers etc., as well as oil filters etc. which are required to exhibit a high level of formability and corrosion resistance.

BACKGROUND ART

A material for fuel tanks of automobiles and motorcycles is required to have not only weldability but also resistance to general corrosion on its outer side (hereinafter called "cosmetic corrosion resistance") and to corrosion caused by fuels such as gasoline on its inner side (hereinafter called "fuel corrosion resistance"). Such corrosion resistance is collectively referred to as "corrosion resistance" or "corrosion resistance after forming". Conventionally, a ternesheet (10–25% Sn—Pb alloy-plated steel sheet) has widely been used as a material for fuel tanks. However, it has the following disadvantages: (i) Pb included in the ternesheet is harmful to the human body, (ii) the plated layer is easily dissolved in oxides of alcohols when an alcohol-containing fuel is used, and (iii) formation of pin holes in the plated layer is inevitable, resulting in preferential corrosion of iron from these pin holes since iron is electrochemically base compared with the plated layer, so perforation corrosion resistance is not satisfactory. An alternative to ternesheet, therefore, has long been sought.

Recently, in order to reduce the environmental problems caused by exhaust gases, an alcohol-containing fuel, called "gasohol", is being used increasingly in some countries. Gasohol is a mixture of gasoline and alcohol. For example, the mixture referred to as M15 contains about 15% methanol, and that referred to as M85 contains about 85% methanol. Conventional terneplate is easily corroded by such an alcoholic fuel, so a material which can exhibit improved resistance to corrosion caused by an alcohol-containing fuel is strongly desired.

For this purpose, it has been proposed to apply a Zn—Ni alloy electroplated steel sheet to fuel tanks because of its marked resistance to corrosion and its material cost. Prior art references in this respect are as follows.

Japanese Patent Application Laid-Open Specification No. 45396/1983 discloses a surface-treated steel sheet for fuel tanks having a Zn—Ni alloy plating with an Ni content of 5–50 wt % and a thickness of 0.5–20 μm, and a chromate film on the Zn—Ni alloy plating.

Japanese Patent Application Laid-Open Specification No. 106058/1993 discloses a surface-treated steel sheet for fuel tanks having a Zn—Ni alloy plating with an Ni content of 8–20 wt % and a weight of 10–60 g/m$^2$ and a chromate film on the plating.

These surface-treated steel sheets are excellent with respect to cosmetic corrosion resistance, but they are not adequate with respect to fuel corrosion resistance after they are formed into fuel tanks. Especially, fuel corrosion easily occurs under severe corrosive circumstances, e.g., when the plates are exposed to alcohol-containing fuels contaminated with salt water. However, if a chromate film or electroplated layer is thickened so as to further strengthen protection of the tank from fuel corrosion, weldability is inevitably degraded. Weldability is an essential characteristic for materials for fuel tanks.

From the viewpoint of providing cracks in a plating layer, the following prior art references are noted, but they are totally silent about corrosion resistance after forming.

Japanese Patent Application Laid-Open Specification No. 25679/1993 and No. 337099/1992 disclose surface-treated steel sheets with improved corrosion resistance, which exhibit an improvement in adhesion of coatings against impact, and which comprises a thin substrate layer of an Zn—Ni alloy plating having fine cracks with a width of 0.01–0.5 μm, a crack density of 10–60% in terms of the total crack area, and a Zn—Ni alloy plating layer on the thin substrate Zn—Ni alloy layer. However, these surface-treated steel sheets are to be used for making outer panels of vehicles with improvement in impact adhesion, i.e., steel sheets used as outer panels of automobiles having a painting layer which does not swell even if the painting layer is impaired by bouncing of pebbles or by scratches. The impact adhesion of an upper plating layer of Zn—Ni alloy can be improved through the anchoring effect since the upper Zn—Ni alloy plating layer is placed into cracks of the plating underlayer.

Japanese Patent Application Laid-Open Specification No. 297490/1987 discloses a blackened, surface-treated steel sheet comprising a 0.5–2 μm thick Zn—Ni alloy plating layer with a Ni content of 3–15%, and a 0.3–1.5 μm thick Ni alloy plating layer with a Ni content of 15–75%, which is placed on the Zn—Ni alloy plating layer, fine cracks being formed uniformly over at least the surface of the Ni alloy plating layer.

An area of fine cracks 0.1–0.4 μm wide, 1–10 μm long, and 0.2–1 μm deep comprises 60% or more of the total area of cracks. The presence of such fine cracks causes the steel sheet to be blackened. In addition, the above-mentioned steel sheet comprised of double plating layers has a Zn—Ni alloy plating layer with a low content of Ni, and a blackened layer to be placed thereon with a high content of Ni and having fine cracks. The adhesion of the blackened layer after forming is therefore improved markedly.

It is apparent that in the above-mentioned example, since the Ni content of the upper Zn—Ni plating layer is very large, a high level of corrosion resistance cannot be achieved even in the form of a plate if a chromate film is applied to the upper layer.

Furthermore, since the Zn—Ni plating alloy layer is of the dual layer type (thickness of the underlayer≧thickness of the upper layer), and cracks formed in the upper layer of the plating do not propagate to the underlayer, cracks newly formed in the under layer during press forming expose the substrate steel sheet and the corrosion resistance after forming is degraded markedly.

DISCLOSURE OF INVENTION

An object of the present invention is to develop a technology which can solve prior art problems relating to a surface-treated steel sheet having a Zn—Ni alloy plating layer+chromate film, and which can improve fuel corrosion resistance, i.e., resistance to corrosion caused by an alcohol-containing fuel of such a sheet without a degradation in weldability and without an increase in costs.

The inventors of the present invention, with an aim to achieve such an object, carried out investigations and discovered that fuel corrosion resistance is markedly improved when electroplated specimens are kept in an electroplating solution for a short time without application of an electric current after finishing electroplating in a continuous process of Zn—X alloy (X is one or more of Ni, Co, Mn, and Cr, hereafter collectively referred to as "X") electroplating in an acidic electroplating solution. While examining the cause of such improvement in corrosion resistance, the inventors found that cracks are formed in the Zn—X alloy layer while the electrodeposited sheet is immersed in the acid electroplating solution, and the presence of such cracks in the electroplating layer can improve the fuel corrosion resistance when the density, maximum width, and depth of the cracks are within specific ranges.

Thus, according to the present invention, cracks having a given density are formed in a Zn—Ni alloy plating layer, and a chromate film is placed directly on a plating layer having the cracks to penetrate into the cracks so that (1) the chromate film is firmly fixed due to the anchoring effect, (2) the presence of cracks increases the covering area of the chromate film exhibiting improved corrosion resistance, (3) formation of newly developed cracks during press forming, which expose the substrate steel, is suppressed. As a whole, therefore, it is possible to improve corrosion resistance by means of previously forming cracks in the plating layer and then covering the cracks with a chromate film. The disclosures made in the before-mentioned Japanese Patent Application Laid-Open Specification No. 25679/1993 and No. 337099/1992 are totally different from the present invention with respect to structure, technical idea, and utility of the invention. Especially, the present invention provides surface-treated steel sheets suitable for making fuel tanks of vehicles, kerosine tanks, and oil filters, which require a high level of corrosion resistance after forming into shapes.

Comparing the present invention with the disclosure made in Japanese Patent Application Laid-Open Specification No. 297490/1987, it is noted that the structure of a plating layer and the purpose and effect of cracks are totally different from each other.

Thus, the present invention is a surface-treated steel sheet exhibiting improved corrosion resistance after forming, which comprises a Zn—X alloy electroplated layer in an amount of 5–50 g/m$^2$ on at least one side of the steel, an alloy composition of the layer being such that X is at least one substance selected from the group consisting of Ni: 3–18 wt %, Co: 0.02–3wt %, Mn: 25–45 wt %, and Cr: 8–20 wt %, and a chromate film placed on the Zn—Ni alloy electroplated layer in an amount of 10–200 mg/m$^2$ as metallic Cr, the Zn—Ni alloy plating layer having cracks, the density of which is 1000–150000 in terms of the number of plated regions surrounded by cracks in a visual field measuring 1 mm×1 mm, with cracks having a maximum width of 0.5 $\mu$m or less comprising 90% or more of the total number of the cracks, and with cracks having a depth of 80% or more of the thickness of the plating layer comprising 80% or more of the total number of the cracks.

In another aspect, the present invention is a surface-treated steel sheet exhibiting improved corrosion resistance after forming, which comprises a Zn—X alloy electroplated layer in an amount of 7 g/m$^2$ or less on at least one side of the sheet, an alloy composition of the layer being such that X is at least one substance selected from the group consisting of Ni: 3–18 wt %, Co: 0.02–3 wt %, Mn: 25–45 wt %, and Cr: 8–20 wt %, a Zn plating layer in an amount of 10–50 g/m$_2$, which is placed as a underlayer of the Zn—Ni alloy electroplated layer and which is less noble potential than the Zn—Ni alloy electroplated layer, and a chromate film placed on the Zn—Ni alloy electroplated layer in an amount of 10–200 mg/m$^2$ as metallic Cr, the Zn—Ni alloy plating layer underlying the chromate film having cracks with a density of 1000–150000 in terms of the number of plated regions surrounded by cracks in a visual field measuring 1 mm×1 mm with cracks having a maximum width of 0.5 $\mu$m or less comprising 90% or more of the total number of the cracks.

In an embodiment of the present invention, as a first plating layer, a plating layer containing 70 wt % or more of Ni is placed in an amount of 0.001–5 g/m$^2$ underneath the Zn—X alloy plating layer.

In another embodiment of the present invention, a Zn plating layer in an amount of 7 g/m$_2$ or less may be placed on the Zn—Ni alloy electroplated layer, and the chromate film is placed on this Zn plating layer. In this case, cracks may also be provided on the Zn plating layer.

In still another embodiment of the present invention, a thin resin coating may be applied to the chromate film. Alternatively, the chromate film may contain a lubricating agent.

BEST MODE FOR CARRYING OUT THE INVENTION

Figure 1:
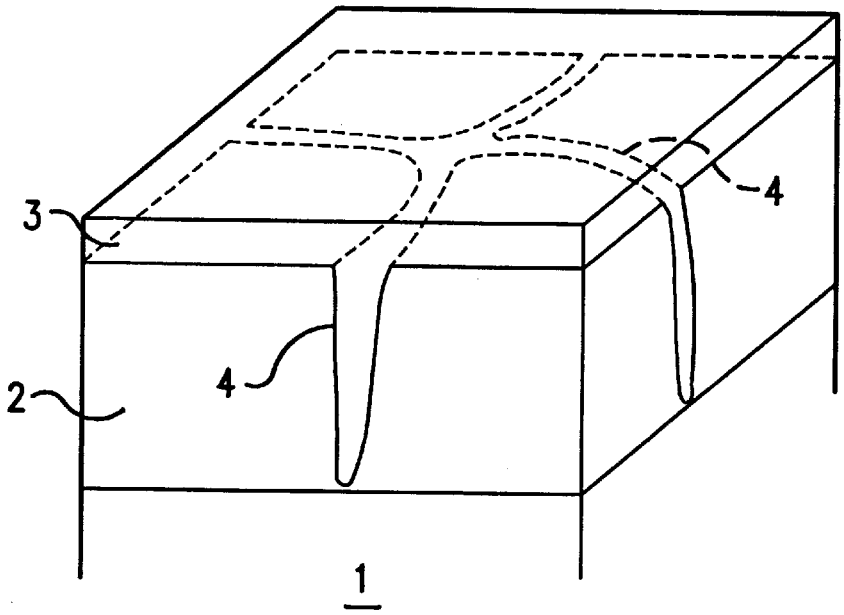
FIG. 1 is a schematic sectional view of a plating layer of the surface-treated steel sheet of the present invention.

FIG. 1 is a schematic illustration of a sectional view of a plating layer of the surface-treated steel sheet of the present invention, in which a Zn—X alloy plating layer 2 is applied to a steel sheet 1, optionally after application of pre-plating (not shown), and a chromate film 3 is placed on the plating layer 2. Cracks 4 are formed in the plating layer 2.

According to the present invention, before application of the Zn—Ni alloy plating layer 2, optionally, an Ni containing pre-plating layer with an Ni content of 70 wt % or more may be applied in an amount of 0.001–5 g/m$^2$.

The purpose of providing such a pre-plating layer is to further improve the corrosion resistance after forming, which is the main object of the present invention, by means of causing propagation of cracks to atop just before the pre-plating layer, but without the cracks reaching the substrate steel sheet.

Since Ni is more noble than Fe, nickel is hard to oxidize, and a slight amount of plating of nickel is effective to prevent oxidation of the surface of a ferrous substrate. Thus, it is advisable to use the nickel plating as pre-plating to the Zn—Ni alloy plating layer 2 provided with cracks. When such pro-plating is applied, the cracks formed in the Zn—Ni alloy plating layer 2 do not directly reach the substrate, and the ferrous surface of the substrate can be protected successfully by the pre-plating nickel layer, resulting in a marked improvement in corrosion resistance after forming.

The pre-plating is carried out preferably by electroplating, or displacement plating (electroless immersion plating) since a sufficient amount of deposition can be obtained. Alternatively, an Ni-containing liquid or solid (paste-like) may be applied to the substrate. As long as the nickel content thereof is 70 wt % or more, any compositions may be employed for the remaining 30 wt %. For example, ferrous group elements such as Fe, Co, or transitional or other elements, such as Zn, Cr, Mn, Cu, Al, etc. may be incorporated in the composition. Furthermore, elements such as P, S, etc. which form an amorphous phase with Ni and which are electrodeposited or deposited by displacement, may also be incorporated in the composition. Organic substances or oxides of elements such as C, H, O, N, P, S, and other elements may be present in the composition.

In order to realize the intended effect of the pre-plating sufficiently, it is advisable to define the Ni content of the first layer, i.e., the pre-plating layer as 70 wt % or more and also to define the amount of the first layer as 0.001–5 g/m$^2$. When the Ni content is smaller than 70 wt %, it is rather difficult to realize improved oxidation resistance inherent to the addition of Ni. When the amount of pre-plating is smaller than 0.001 g/m$^2$, the Zn—Ni alloy plating layer 2, i.e., a second plating layer, does not exhibit a satisfactory level of corrosion resistance after forming. In contrast, when the amount is more than 5 g/m$^2$, the formability of the resulting surface-treated steel sheet is degraded due to the development of a hard and brittle Ni alloy phase. An increase in manufacturing costs is also inevitable. Preferably, the amount of deposition is 0.005–0.1 g/m$^2$.

An alloy composition of an electroplated Zn—X alloy of a plated steel sheet used in the present invention is one in which X is at least one substance selected from the group consisting of Ni: 3–18 wt %, Co: 0.02–3 wt %, Mn: 25–45 wt %, and Cr: 8–20 wt %. When X is two or more of these elements, preferably, the second element and the other element, if any, are selected from Ni: 3–18 wt %, Co: 0.02–3 wt %, Mn: 25–45 wt %, and Cr: 8–20 wt %. Alternatively, the second element and the other element, if any, may be selected from Ni, Co, Mn, and Cr and the total amount thereof may be restricted to 5 wt % or less.

The expression "X content for the plating layer" means the X content on the average over the whole plating layer not just after electroplating of the Zn—X alloy, but after formation of cracks. In this specification, such an X content is referred merely to as the X content.

When X is a single element and the X content is below the above-defined range for each of the alloying elements, cosmetic corrosion resistance and fuel corrosion resistance after forming are not satisfactory. on the other hand, when the X content is higher than the above-defined range for each of the alloying elements in a case where one or more of X is added, formability and cosmetic corrosion resistance are not satisfactory.

Especially, when two or more elements X are added and the total amount of X is 5 wt % or less, the second and other elements are added so as to further improve cosmetic corrosion resistance. When the total amount thereof is over 5 wt %, formability is degraded slightly. In the case of Ni alone as X, the content thereof is preferably 3–14 wt % or 9–18 wt %, more preferably 10–14 wt %, and still more preferably 11–13 wt %.

When the amount of deposition (unless otherwise indicated, the amount of deposition on one side) is smaller than 5 g/m$^2$, the corrosion resistance after forming is not satisfactory. On the other hand, when the amount is larger than 50 g/m$^2$, the improvement in properties is saturated and economy becomes poor, and moreover, weldability is degraded. Preferably the amount of deposition is 7–30 g/m$^2$, and more preferably it is 10–25 g/m$^2$.

According to another embodiment of the present invention, under the Zn—Ni alloy plating layer, such an underlayer as mentioned below may be provided. The underlayer may be a Zn-containing plating layer which is less noble than the upper layer of Zn—Ni alloy plating layer in the potential series. Examples of the underlayer are a pure Zn plating layer, a Zn—Fe alloy plating layer, etc. In such a case, when the amount of the uppermost layer of the Zn—Ni alloy plating layer is more than 7 g/m$^2$, formability as well as weldability are degraded. The amount of the uppermost Zn—Ni alloy plating layer is preferably 2–6 g/m$^2$.

In these embodiments, when the amount of the underlaying Zn-containing plating layer (unless otherwise indicated, the amount of deposition on one side) is smaller than 10 g/m$^2$, corrosion resistance after forming is not satisfactory. When the amount is larger than 50 g/m$^2$, the improvement in properties is saturated and economy becomes poor, and moreover, weldability is degraded. The amount of the underlaying Zn-containing plating layer is preferably 12–30 g/m$^2$ and more preferably 15–25 g/m$^2$.

The underlaying Zn-containing plating layer may be applied directly to the steel sheet surface. Alternatively, as mentioned before, the underlaying Zn-containing plating layer may be provided on a pre-plating layer, such as an Ni plating layer, or on another plating layer. Such an underlayer may be provided optionally.

According to the present invention, by means of forming cracks with a density of 1000–150,000 regions/mm$^2$ on one surface of the Zn—X alloy plating layer and placing a chromate film on the plating layer, fuel corrosion resistance after forming can be drastically improved. Although the reason for this improvement is not completely clear, it is thought that the corrosion resistance is improved as a whole by an anchoring effect of a chromate film which penetrates into cracks to fix the chromate film firmly, by an increase in the surface area covered with the chromate film due to the presence of cracks, and by a decrease in the number of newly-occurring cracks during press forming due to pre-formation of cracks and covering of these cracks with a chromate film. In this respect, under usual conditions, when the Zn—X alloy plated steel sheet of the crack-free type is subjected to press forming, cracks are newly formed, and the substrate sheet is exposed to air, resulting in degradation in corrosion resistance.

Figure 2:
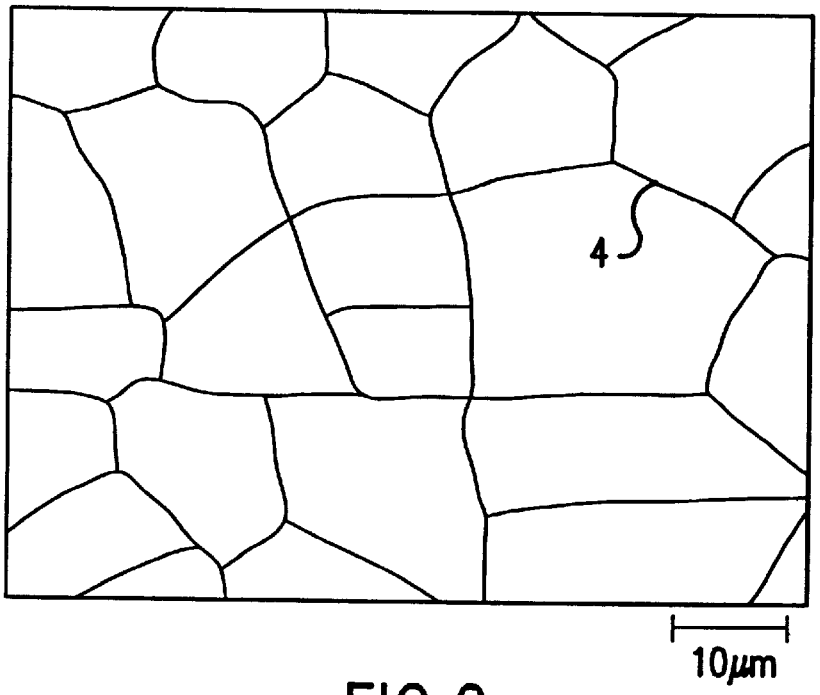
FIG. 2 is a schematic illustration of cracks provided in the surface of the plating layer.

In the present invention, the density of cracks is defined by the number of plated regions surrounded by cracks in a visual field measuring 1 mm×1 mm on the surface of the plating layer. Measurement of the crack density is carried out by randomly taking 30 SEM (scanning electron microscope) photographs of a surface of the plating layer of a specimen at a magnification of 1000 and counting the number of regions surrounded by cracks in a randomly chosen visual field measuring 0.1 mm×0.1 mm for each of the photographs by means of image processing. The average number of regions is determined for all 30 photographs, and the average is multiplied by 100 to obtain a crack density, A "region surrounded by cracks" is, as schematically illustrated in FIG. 2, which is based on an SEM photograph, an area isolated like an island by cracks 4.

According to the present invention, resistance to corrosion caused by gasoline or gasohol, i.e., fuel corrosion resistance after forming can be drastically improved by producing cracks in the surface of a Zn—X alloy plating layer with a density of 1000–150,000 regions/mm$^2$ as determined in the manner above. When the crack density is larger than 150,000 regions/mm$^2$, too many cracks are produced, and the substrate surface covered with the plating layer, i.e., the covering area, is decreased too much, inevitably resulting in a degradation in fuel corrosion resistance after forming. On the other hand, when the crack density is smaller than 1000 regions/mm$^2$, there is almost no improvement in fuel corrosion resistance. Preferably, the crack density is 1000–50,000 regions/mm$^2$.

When the crack density is increased to larger than 1000, the weldability sometimes degrades. Thus, if it is necessary to achieve an especially high level of weldability, it is advisable to reduce the crack density to less than 1000.

According to the present invention, cracks having a maximum width of 0.5 $\mu$m or less comprise 90% or more of the cracks. The maximum width of cracks can be determined by measuring the crack width of the largest crack among cracks found in a visual view of 0.1 mm×0.1 mm on all 30 SEM photographs. The proportion of the number of the photographs in which the maximum width is 0.5 $\mu$m or less with respect to the total number of the photographs is determined. When the proportion of cracks having a maximum width of 0.5 $\mu$m or less is smaller than 90%, the shielding effect of a plating layer is impaired, resulting in a degradation in both cosmetic corrosion resistance and fuel corrosion resistance after forming. Preferably, the proportion of cracks having a maximum crack width of 0.4 $\mu$m or less is 90% or more.

The depth of cracks can be determined by taking an SEM photograph of a section with a length of 1 mm of a sample at a magnification of 2000× and measuring the crack depth found in the section on the photograph. The resulting measurements of the crack depth are compared with the depth, i.e., the thickness of the plating layer. According to the present invention, the proportion of cracks having a depth of 80% or more of the depth of the plating layer is defined as 80% or more of the total number of cracks. Within this range of cracks, a satisfactory level of cosmetic corrosion resistance and fuel corrosion resistance after forming can be obtained. When the depth of cracks is shallow, i.e., less than 80% of the thickness of the plating layer, or when the proportion of cracks with a depth of 80% or more of the thickness of the plating layer is smaller than 80%, cracks are newly generated during press forming, resulting in a degradation in cosmetic corrosion resistance and fuel corrosion resistance after forming.

In a preferred embodiment, the crack density is 1000–50,000, cracks having a maximum width of 0.4 $\mu$m or less comprise 90% or more of the total number of cracks, and the proportion of cracks with a depth of 80% or more of the thickness of the plating layer is 95% or more of the total number of cracks.

There is no restriction on how to produce these cracks in the surface of a Zn—X alloy plating layer. Mechanical methods of applying plastic deformation, such as bending after plating or stretching after plating, are possible. Chemical methods, such as etching with an acid or alkali aqueous solution, are preferred, since it is possible to control the crack density and to produce uniform cracks more easily by chemical methods. In order to adjust the crack density, etc. as defined above, process conditions, such as immersing conditions, especially an immersing time can be changed.

When the electroplating of a Zn—X alloy is carried out using an acidic plating solution (e.g., a sulfate bath), the acidic plating solution can also be used in etching. Namely, as described before, after completing electroplating of a steel sheet with a Zn—X alloy in an acidic bath, application of an electric current is stopped while the steel sheet is kept immersed in the plating bath so as to carry out etching of the plating surface to form cracks. Thus, without using a separate tank or an acidic or alkaline aqueous solution which is prepared separately, it is possible to carry out etching to form the necessary amount of cracks in the surface of the plating layer using a conventional plating apparatus and a conventional plating solution without modification. Thus, it is possible to efficiently produce a surface-treated steel sheet according to the present invention at lower costs without additional processing steps. Also, by using a separate tank annexed to a plating bath, immersion into the plating solution can be performed.

When a surface-treated Zn—X alloy electroplating steel sheet of the present invention is used to fabricate a fuel tank, for example, a plating layer applied to a side corresponding to an inner wall of the tank may be immersed in an acidic liquid so as to develop cracks as defined in the present invention, and the other side corresponding to an outer surface of the tank may also suffer from cracks in the same manner as the inner wall. In this preferred embodiment, the fuel corrosion resistance of the inner wall can be improved and the cosmetic corrosion resistance of the outer surface of the fuel can also markedly be improved. In fact, it is advantageous for both sides of a steel sheet to be subjected to etching, since complicated processing, such as sealing is required to achieve etching of only one side of the steel sheet by means of immersing the sheet into an acidic electroplating bath.

Figure 3:
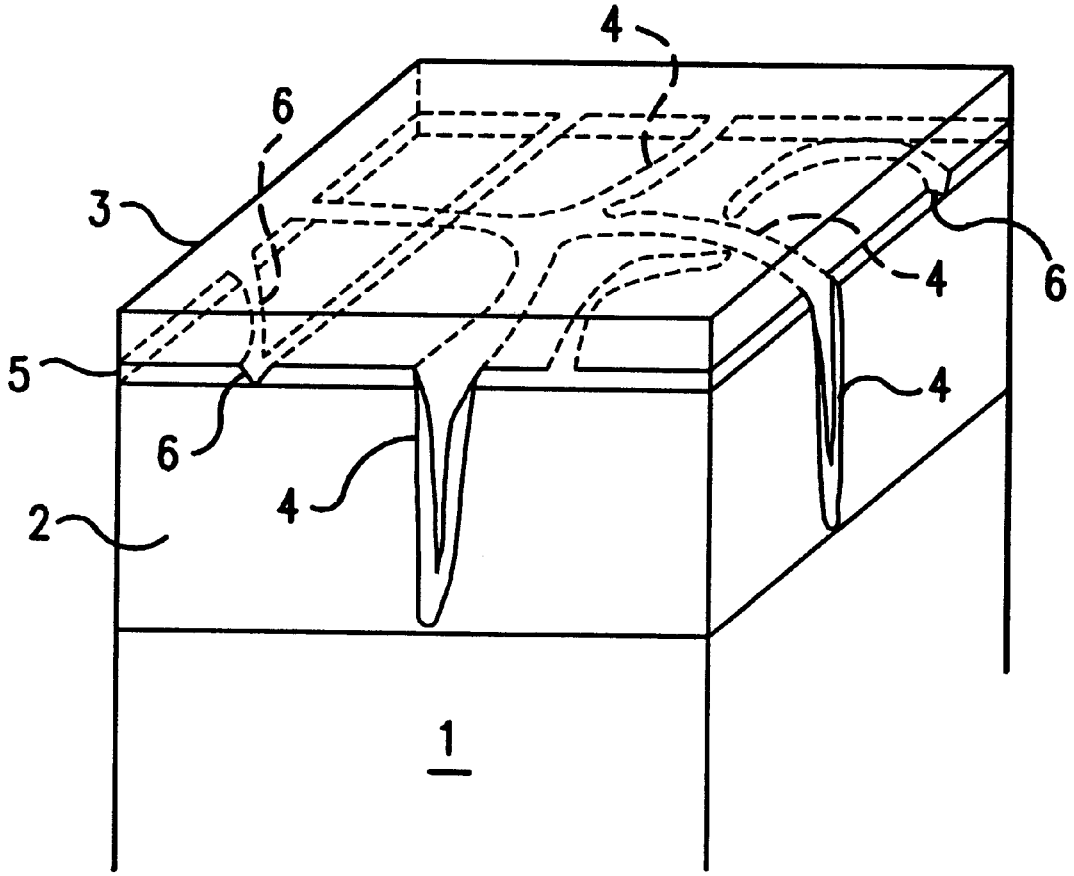
FIG. 3 is a schematic sectional view of a plating layer of another embodiment of the present invention.

According to another embodiment of the present invention, as shown in FIG. 3, a Zn plating layer 5 (referred to as "Zn thin plating layer") may be applied to the Zn—X alloy electroplating layer in an amount of 7 g/m$^2$ or less. In the FIG. 3, the same elements are indicated by the same reference number as in FIG. 1.

An alloy composition of this Zn thin plating layer 5 may be different from that of the underlaying Zn—X alloy plating layer, but It is advantageous for the two layers to have the same alloy composition. Examples of a Zn plating layer having an alloy composition different from the composition of the Zn—X alloy are a pure Zn plating layer and a Zn—Fe alloy plating layer. The amount of a plating layer is preferably restricted to 5 g/m$^2$ or less from the viewpoint of costs, When such a Zn thin plating layer 5 is provided on the Zn—Ni alloy to form a dual layer structure, it is possible to prevent cracks from propagating if cracks are formed during processing, since cracks introduced into the upper layer or into the underlayer do not progress beyond the interface between the upper layer and the underlayer so that the substrate of ferrous surface is not exposed. Thus, cosmetic corrosion resistance as well as fuel corrosion resistance can be improved markedly.

Cracks 6 may be formed in this Zn plating layer, and the method of introducing the cracks into the layer is not restricted to a specific one. However, it is desirable to apply etching in an electroplating bath in the same manner as for the underlaying Zn—X alloy plating layer. Although the density of cracks and the width of cracks are not restricted to specific ones, it is preferable to restrict them to the same ranges as for the underlaying Zn—X alloy plating layer such that the crack density is 1000–150000 and the proportion of cracks having a maximum width of 0.5 $\mu$m or less is 90% or more. The proportion of cracks having a depth 80% or more than the thickness of the plating layer is preferably 80% or more.

After a Zn—X alloy plating layer is provided in accordance with the present invention, chromate treatment is performed on the layer to form a chromate film on the plating layer on the side corresponding to the side which is used without being coated with paint and which requires a high level of corrosion resistance after forming. Since the presence of the chromate film covers the cracks in the plating layer and is effective to drastically improve cosmetic corrosion resistance, it is advisable to apply the chromate film even to the side on which a paint is to be coated.

According to the present invention, a chromate film is provided in an amount of 10–200 mg/m$^2$ on a metallic Cr basis. When the amount of a chromate film is smaller than 10 mg/m$^2$, a satisfactory level of corrosion resistance after forming is not established. On the other hand, when the amount is larger than 200 mg/m$^2$, weldability, such as ease of seam welding, is deteriorated. A preferred amount of a chromate film is 50–180 mg/m$^2$ on a metallic Cr basis.

A thin resin coating layer (not shown in the drawings) may be provided on the chromate film. In the present invention, such a thin resin coating layer is provided in order to further improve cosmetic corrosion and fuel corrosion resistance after forming. A thick resin coating layer results in a degradation in weldability. The thickness of the coating is preferably restricted to 5 $\mu$m or less. More preferably, it is 0.5–2 $\mu$m.

A resin composition of this thin coating may be any one which is the same as that used for preparing conventional pre-coating steel sheets. In order to balance improvements in properties such as edge corrosion resistance, formability, fuel corrosion resistance, and weldability, it is advisable to employ epoxy resins, acrylic resins, polyester resins, urethane resins, or phenolic resins in an organic solvent or in an aqueous solution. A single one of these resins may be used, or two or more of them may be used in combination.

The amount of a binder resin to be incorporated in this thin resin layer is preferably at least 60% by weight but at most 90% by weight. A more preferable range for the binder is at least 65% by weight but at most 85% by weight.

Optionally, an organic lubricating agent and an inorganic pigment may be added to the resin coating layer.

Preferred examples of the organic lubricating agent are polyolefine compounds, carboxylate compounds, and poly (alkylene) glycol compounds.

Examples of the inorganic pigment are filler pigments such as silica, alumina, kaoline, calcium carbonate, and barium sulfate; non-chromic corrosion-resistant pigments such as phosphate pigments, vanadate pigments, and molybdate pigments; and color pigments such as titanium oxide, carbon black, and ferrous oxides.

Such a thin resin coating layer may be applied by any method, i.e., by a roll coating method, or curtain flow coating method, or spraying method.

A drying and curing method for the coatings is not restricted to a specific one. Conventional hot ovens and induction heating ovens may be used to achieve drying and curing of the coatings. Although a temperature required for drying and curing the coatings varies depending on the type of resin of the coatings, the drying and curing process is generally carried out at a temperature of 100–260° C. as a maximum temperature achieved by the steel sheet being processed for the period of time of from 5 seconds to 3 minutes.

The chromate film may be of the coating type, electrolysis type, or reaction types The coating type is preferred when the chromate film contains a lubricating resin. When a large amount of $Cr^{+6}$ is contained in a chromate film, since $Cr^{+6}$ is hygroscopic, water contained in fuel is adsorbed and fixed on the surface of the chromate film, and the surface area on which the water is fixed undergoes severe local corrosion. It is desirable that the content of $Cr^{+6}$ of the chromate film be decreased to as low a level as possible. In this respect, it is preferable to restrict the content of $Cr^{+6}$ to 5% or less with respect to the total Cr content.

According to another preferred embodiment, in order to further strengthen the corrosion resistance of the chromate film, silica is added to the film in an amount such that the eight ratio of $SiO_2$/Cr is 1.0–10.0. When the weight ratio is smaller than 1.0, no further improvement in corrosion resistance of the chromate film is expected. In contrast, when the ratio is over 10.0, a chromate solution is unstable, sometimes resulting in problems in manufacturing operations. Formability of the film is also impaired. Preferably, the ratio of $SiO_2$/Cr by weight is 1.5–9.5.

Silica used in the present invention includes dry silica (gas phase silica or fumed silica), and wet silica (colloidal silica or silica sol). Dry silica, which is less hygroscopic, is preferred to wet silica. When a chromate film contains silica, the amount of the chromate film based on metallic Cr is the same as in the above.

According to another embodiment of the present invention, in order to further improve corrosion resistance after forming, a lubricating agent may be added to the chromate film. This lubricating agent is not restricted to a specific one, but any type of aqueous resins may be employed so long as it is compatible with a chromic acid solution. Examples of such compatible aqueous resins are acrylic resins, epoxy resins, and amine resins. The ratio of this type of resin to metallic chromium (resin/Cr) is preferably 0.5–1.5.

EXAMPLE

The present invention will be described in more detail in conjunction with the following working examples.

Example 1

Preparation of Samples of Surface-Treated Steel Sheet

A cold-rolled steel sheet corresponding to JIS SPCE and having a thickness of 0.8 mm was electroplated with a Zn—X alloy on both sides of the sheet using a sulfate bath under conditions described below to form a Zn—X alloy plated steel sheet. After electroplating was finished, plating layers on both sides of the plated steel sheet were subjected to etching using the same electroplating sulfate bath by immersing the sheet in the acidic plating solution to introduce cracks into the surface of the Zn—X plating layer. The crack density, the maximum crack width, and the crack depth were varied by adjusting the immersion time in the electroplating solution. In a case in which a Zn—X alloy plating layer having a lower crack density and a lower proportion of cracks with a maximum crack width of 0.5 $\mu$m or less was required, biaxial stretching was applied to the plated steel sheet after etching. The crack density, maximum crack width, and crack depth of the cracks in the surface of the plating layer after etching were determined, as mentioned before, on the basis of SEM photographs.

(Zn—X Alloy Electroplating Conditions)

| | | |
|---|---|---|
| Plating bath composition: | X (sulfate) | 0.02–1.1 mol/L |
| | Zn ($ZnSO_4$) | 0.4–0.8 mol/L |
| | Na ($Na_2SO_4$) | 1 mol/L |
| | pH | 1.5–2.0 (Sulfuric acid added) |
| Plating conditions: | Bath temperature | 45–50° C. |
| | Current density | 50–100 A/dm$^2$ |
| | Flow rate | 0.06–1.40 m/s |

After cracks were formed in the surface of a plating layer on both sides of a Zn—X alloy plated steel sheet by etching, a chromate solution of the coating type having the below-mentioned composition was applied to both surfaces of the sheet with a roll coater, and the chromate coating was baked at 150–300° C. to form a chromate film. Thus, the surface-treated steel sheet according to the present invention was produced.

As silica, dry silica having an average primary particle diameter of 7 nm (tradename "Aerosil 200") was used. For some of the samples, wet silica having an average primary particle diameter of 10 nm (tradename "Snowtex O") was used.

(Composition of chromate Treatment Solution)

| | |
|---|---|
| $Cr^{3+}$ | 50 g/L |
| $Cr^{6+}$ | 2 g/L |
| $SiO_2$ | 170 g/L |

The thus-prepared surface-treated steel sheets were evaluated for fuel corrosion resistance against gasoline and alcohol-containing fuel, cosmetic corrosion resistance, and weldability as described below. Test results are shown in Table 1.

Figure 4:
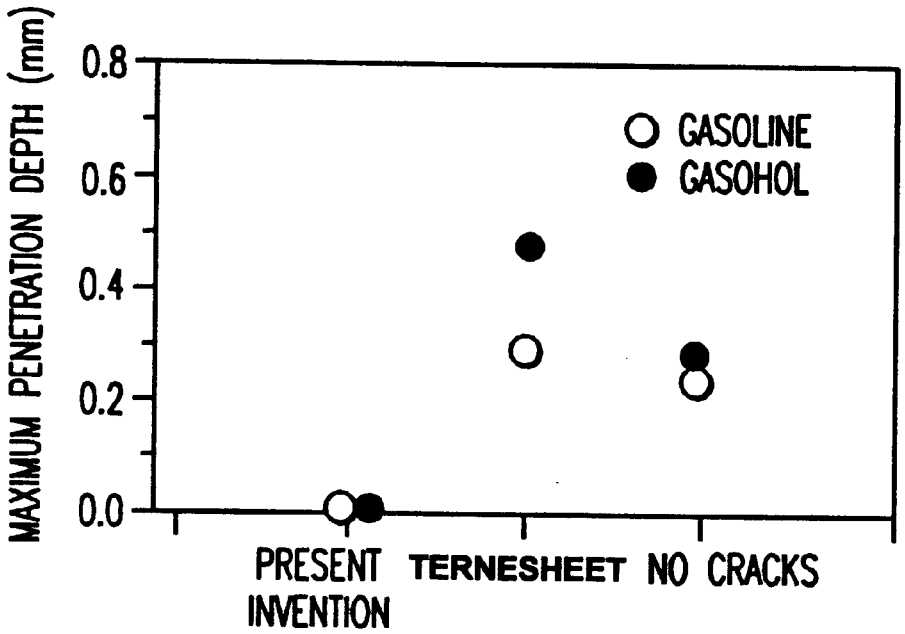
FIG. 4 is a graph showing the results of working examples of the present invention, in which fuel corrosion resistance after forming is shown for the surface-treated steel sheet of the present invention and that of a conventional surface-treated steel sheet.

FIG. 4 shows a graphic comparison of the present invention with the prior art with respect to the fuel corrosion resistance to gasoline and gasohol. In this example, Run No. 1 of Table 1 was used as an example of the present invention. A comparative example was the case in which cracks were not formed for Run No. 1. The fuel corrosion resistance of the electroplated layer having cracks was approximately three times or more the fuel corrosion resistance of the electroplated layer having no cracks.

In the drawing, conventional ternesheet (Sn/Pb:0.10, coatings 45 g/m$^2$) exhibits a marked degradation in fuel corrosion resistance. Since portions of ternesheet corresponding to shoulder and wall portions of a punch are corroded severely, it is supposed that an electroplated layer damaged during forming is easily corroded.

Test Procedures (Fuel Corrosion Resistance)

Press-punched blanks of the surface-treated steel sheet were deep drawn into cylinders to form cups under the following conditions, and 30 ml of gasoline or gasohol having the below-described compositions was poured into each of the cups. After sealing, the cups were allowed to stand for 180 days. The maximum penetration depth (Pm) on the inner wall was determined to evaluate fuel corrosion resistance (n=2).

◎: Pm<0.1 mm

O: 0.1 mm≦Pm<0.2 mm

Δ: 0.2 mm≦Pm<0.5 mm

X: 0.5 mm≦Pm

Cup Drawing Conditions

| | |
|---|---|
| Blank diameter: | 100 mm |
| Punch diameter: | 50 mm (shoulder r = 5 mm) |
| Die diameter: | 51 mm (shoulder r = 5 mm) |
| BH (Blank Holder) pressure: | 10 KN |
| Bulged height: | 30 mm |
| Surface roughness: | #1200 grinding |
| Forming carried out without a lubricant (degreased before forming) | |

Degreasing Conditions

Immersing in 2% Reedsol (tradename) solution (53° C.) for 3 minutes—immersing in distilled water (room temperature) for 1.5 minutes—drying (165° C.) for 8 minutes—standing at room temperature for 20 minutes—drying (165° C.) for 15 minutes.

Fuel Compositions

| | | |
|---|---|---|
| Gasoline: | Regular gasoline | 95% |
| | 5% NaCl aqueous solution | 5% |
| Gasohol M15: | Regular gasoline | 84% |
| | Aggresive methanol | 15% |
| | Distilled Water | 1% |

(Note) Aggressive methanol is a mixture of 95% of anhydrous methanol+5% of an aqueous solution containing 0.1% NaCl, 0.08% $Na_2SO_4$, and 10% formic acid.

(Cosmetic Corrosion Resistance)

Cup drawing of surface-treated steel sheets into cylinders was repeated under the same conditions as in the fuel corrosion resistance test except that the bulged height was changed to 25 mm. After shaping, the edge portion of each specimen was sealed. The outer surface of each of the resulting specimens was subjected to SST (salt spray test) for 2000 hours according to JIS Z 2371. Cosmetic corrosion resistance was evaluated in terms of the maximum depth of penetration (Pm) after 2000 hours of SST.

◎: Pm<0.1 mm

O: 0.1 mm≦Pm<0.4 mm

Δ: 0.4 mm≦Pm<0.8 mm

X: 0.8 mm≦Pm (Weldability)

Continuous seam welding was carried out over a length of 100 meters under the following conditions. After welding, the microstructure of a section of a welded portion was observed to classify the weldability into one of the following grades.

Seam Welding Conditions

| | |
|---|---|
| Welding force: | 300 kgf |
| Current-on time: | 3 cycles |
| Current-off time: | 2 cycles |
| Current: | 13,000 A |
| Welding speed: | 2.5 m/min |

Classification of Weldability

O: Good welding

Δ: Blow holes existing

X: Not welded portions existing

Example 2

In this example, Example 1 was repeated so as to show that corrosion resistance after forming is also improved by the provision of cracks, In this example, the surface treated steel sheets had an electroplated layer and a chromate film shown in Table 2. Results are shown in FIG. 5, in which examples of the present invention are for electroplated steel sheets having cracks falling within the range of the present invention with respect to the maximum width and the depth of cracks.

According to the present invention, there was substantially no penetration after 2000 hours, but there was a penetration of 0.8 mm for the conventional example and 0.6 mm for the comparative example.

Figure 5:
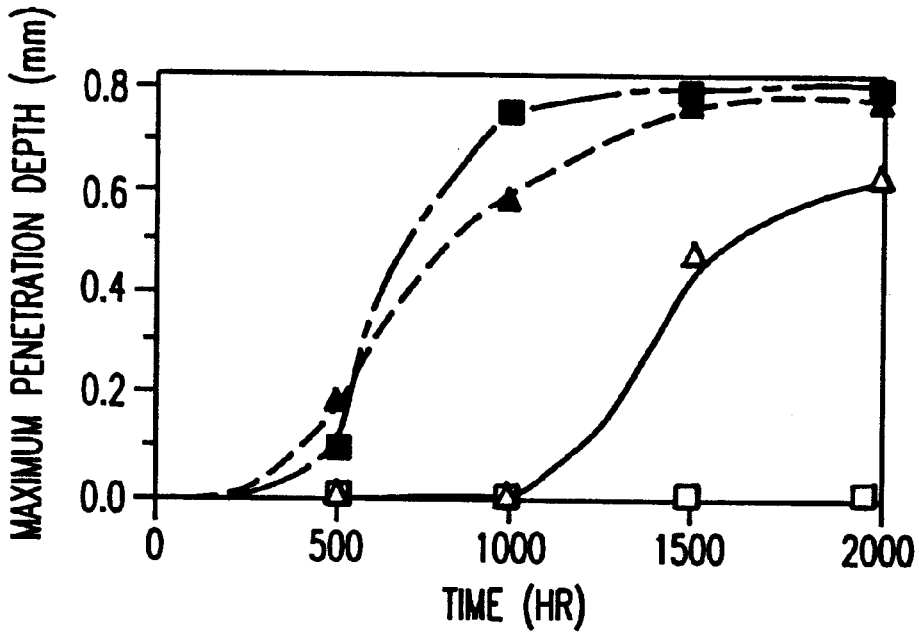
FIG. 5 is a graph showing results of a cosmetic corrosion resistance test of the surface-treated steel sheet.

The corrosion test of FIG. 5 was the same SST (Salt Spray Test) according to JIS Z2371 as in Example 1 and was carried our for 2000 hours. Such conditions were relatively severe.

Example 3

In this example, Example 1 was repeated so as to determine the influence of the depth of cracks on corrosion resistance after forming. Table 3 shows the influence of the proportion of cracks less than 80% the depth of the electroplating layer, i.e., the effects when the proportion of cracks having a depth 80% or more of the depth of the plating layer is varied from 0 to 70%. As is apparent from these results, when the proportion is less than 80%, the rating is "Δ" or "X", which means occurrence of corrosion to an extent unacceptable from a practical point of view. Thus, when the proportion is 80% or more, a satisfactory level of improvement in corrosion resistance can be achieved.

TABLE 1

| Run No. | % in Plating Layer (%) (Zn = 100 − X %) | Plating Amount ($g/m^2$) | Chromate Amount ($mg/m^2$) | Crack Density (regions/ $mm^2$) | Ratio of cracks <0.5 μm in width (%) | Ratio of cracks 80% or more deeper of the depth of plating layer (%) | Fuel Corrosion Resistance Gasoline | Fuel Corrosion Resistance Gasohol | Cosmetic Corrosion Resistance | Welda-bility | Remarks |
|---|---|---|---|---|---|---|---|---|---|---|---|
| 1 | Ni = 9 | 20 | 80 | 4300 | 100 | 90 | ◎ | ◎ | ◎ | ○ | Invention |
| 2 | Ni = 9 | 19 | 100 | 500* | 80* | 70* | x | x | x | ○ | Comparative |

TABLE 1-continued

| Run No. | % in Plating Layer (%) (Zn = 100 − X %) | Plating Amount ($g/m^2$) | Chromate Amount ($mg/m^2$) | Crack Density (regions/ $mm^2$) | Ratio of cracks <0.5 μm in width (%) | Ratio of cracks 80% or more deeper of the depth of plating layer (%) | Fuel Corrosion Resistance Gasoline | Fuel Corrosion Resistance Gasohol | Cosmetic Corrosion Resistance | Welda-bility | Remarks |
|---|---|---|---|---|---|---|---|---|---|---|---|
| 3 | Ni = 10 | 20 | 98 | 1800 | 85* | 80 | x | x | x | ○ | |
| 4 | Ni = 12, Co = 0.05 | 20 | 90 | 4500 | 98 | 92 | ◎ | ◎ | ◎ | ○ | Invention |
| 5 | Ni = 12, Mn = 3 | 20 | 105 | 5000 | 95 | 90 | ◎ | ◎ | ◎ | ○ | |
| 6 | Ni = 12, Cr = 2 | 20 | 105 | 5100 | 98 | 85 | ◎ | ◎ | ◎ | ○ | |
| 7 | Ni = 13, Co = 0.05 Mn = 3, Cr = 1 | 20 | 110 | 4900 | 95 | 89 | ◎ | ◎ | ◎ | ○ | |
| 8 | Co = 0.02 | 19 | 120 | 5100 | 100 | 95 | ◎ | ◎ | ◎ | ○ | |
| 9 | Co = 0.02 | 19 | 120 | 550* | 75* | 85* | x | x | x | ○ | Comparative |
| 10 | Co = 0.5, Mn = 4 | 19 | 120 | 5000 | 97 | 94 | ◎ | ◎ | ◎ | ○ | Invention |
| 11 | Co = 0.5, Cr = 3 | 19 | 120 | 4800 | 95 | 86 | ◎ | ◎ | ◎ | ○ | |
| 12 | Mn = 45 | 18 | 130 | 8300 | 100 | 88 | ◎ | ◎ | ◎ | ○ | |
| 13 | Mn = 40 | 18 | 130 | 160000 | 98 | 50* | x | x | x | x | Comparative |
| 14 | Mn = 35, Cr = 2 | 18 | 125 | 4000 | 98 | 90 | ◎ | ◎ | ◎ | ○ | Invention |
| 15 | Cr = 8 | 19 | 135 | 3500 | 95 | 91 | ◎ | ◎ | ◎ | ○ | |
| 16 | Cr = 9 | 19 | 135 | 900* | 85* | 60* | x | x | x | ○ | Comparative |
| 17 | Cr = 20 | 18 | 130 | 2000 | 95 | 95 | ◎ | ◎ | ◎ | ○ | Invention |
| 18 | Mn = 25 | 19 | 120 | 3500 | 90 | 90 | ◎ | ◎ | ◎ | ○ | |
| 19 | Ni = 18 | 18 | 130 | 1700 | 90 | 85 | ◎ | ◎ | ◎ | ○ | |
| 20 | Co = 3 | 20 | 130 | 3700 | 95 | 95 | ◎ | ◎ | ◎ | ○ | |
| 21 | Ni = 3 | 20 | 105 | 5000 | 95 | 95 | ◎ | ◎ | ◎ | ○ | |

(Note)
*: outside the range of the present invention

TABLE 2

| Sym-bol | Plating Amount ($g/m^2$) | Plating layer Composition (%) | Chromate Amount ($mg/m^2$) | Crack Density (regions/$mm^2$) | Remarks |
|---|---|---|---|---|---|
| Δ | 23 | Ni = 13 | 110 | 0 | Comparative |
| ○ | 20 | Ni = 13 | 80 | 4800 | Invention |
| □ | 21 | Ni = 12 | 90 | 6700 | |
| ▲ | 45 | Sn/Pb = 0.10 | — | — | Conventional |
| ■ | 30 | Pure Zinc | 60 | — | |

TABLE 3

| Ratio of cracks 80% or deeper of the depth of plating layer (%) | Cosmetic Corrosion Resistance | Gasoline | Gasohol | Plating Amount ($g/m^2$) | Plating Composi-tion (%) | Chromate Amount ($mg/m^2$) | Crack Density (regions/$mm^2$) |
|---|---|---|---|---|---|---|---|
| 30 | ○ | Δ | ○ | 20 | Ni = 11 | 90 | 3600 |
| 50 | ○ | Δ | Δ | 20 | Ni = 11 | 100 | 2800 |
| 80 | Δ | x | Δ | 21 | Ni = 13 | 100 | 7200 |
| 100 | x | x | x | 20 | Ni = 12 | 90 | 5500 |

Example 4

In this example, Example 1 was repeated except that pre-plating was carried out under the following conditions.

[Pre-plating Conditions]

| (Electroplating Conditions) | | |
|---|---|---|
| Plating bath composition: | Ni | 0.01–0.1 mol/L |
| | Other components (Fe, Co, Zn) | 0.0001–0.1 mol/L |
| | Other ions | $SO_4^{2-}$, $NH_4^+$ |
| | pH | 4.5–6.5 |
| | (Sulfuric acid, Ammonia added) | |

-continued

| | | |
|---|---|---|
| Plating conditions: | Bath temperature | 30–40° C. |
| | Current density | 2–8 $A/dm^2$ |
| | Flow rate | 0.06–1.40 m/s |

-continued (Displacement Plating Conditions)

| | | |
|---|---|---|
| Plating bath composition: | Ni | 0.01–0.1 mol/L |
| | Cu | 0.0001–0.01 mol/L |
| | Other ions | $SO_4^{2-}$, $NH_4^+$ |
| | pH | 4.5–6.5 |
| | (Sulfuric acid, Ammonia added) | |
| Plating conditions: | Bath temperature | 30–40° C. |
| | Immersion time | 5–50 sec |
| | Flow rate | 0.06–1.40 m/s |

(Coating and Drying Plating Conditions)

| | | |
|---|---|---|
| Plating composition: | $Ni(en)_3Cl_2$ ("en": ethylenediamine) | 0.01–0.1 mol/L |
| | pH | 4.5–6.5 |
| | (Sulfuric acid, Ammonia added) | |
| | Drying Temp.: | 60–120° C. |

The composition of a chromate treatment solution employed in this example was as follows.

(Composition of Chromate Treatment Solution)

| | |
|---|---|
| $Cr^{3+}$ | 50 g/L |
| $Cr^{6+}$ | 1 g/L |
| $SiO_2$ | 90 g/L |

The results are shown in Tables 4 and 5.

TABLE 4

| Run No. | Pre-plating layer (first layer) Plating Method | Ni Content (%) | Others | Amount (g/m²) | Plating layer (second layer) Composition (X) (%) (Zn = 100 − X %) | Amount (g/m²) | Chromate Amount (mg/m²) |
|---|---|---|---|---|---|---|---|
| 1 | electrolytic | 95 | Fe, Zn | 0.0005* | Ni = 12 | 19 | 100 |
| 2 | " | " | " | 0.001 | Ni = 13 | 20 | 90 |
| 3 | " | " | " | 0.5 | Ni = 13 | 18 | 120 |
| 4 | " | " | " | 5 | Ni = 12 | 21 | 110 |
| 5 | " | " | " | 10* | Ni = 13 | 18 | 110 |
| 6 | " | 70 | " | 0.5 | Ni = 13 | 19 | 120 |
| 7 | " | 55* | " | " | Ni = 12 | 19 | 120 |
| 8 | " | 95 | Co | " | Ni = 13 | 20 | 110 |
| 9 | " | " | Zn | " | Ni = 12 | 18 | 130 |
| 10 | " | " | Co, Zn | " | Ni = 12 | 19 | 110 |
| 11 | displacement | " | Cu | " | Ni = 13 | 20 | 120 |
| 12 | " | 98 | P | " | Ni = 3 | 19 | 120 |
| 13 | coating drying | 95 | C, H, N, Cl | " | Ni = 13 | 20 | 130 |
| 14 | electrolytic | " | Fe, Zn | 0.5 | Ni = 9 | 20 | 120 |
| 15 | " | " | " | " | Ni = 18 | 19 | 120 |
| 16 | " | " | " | " | Co = 3 | 20 | 120 |
| 17 | " | " | " | " | Mn = 25 | 18 | 110 |
| 18 | " | " | " | " | Mn = 45 | 19 | 110 |
| 19 | " | " | " | " | Cr = 8 | 21 | 110 |
| 20 | " | " | " | " | Cr = 20 | 19 | 100 |
| 21 | " | " | " | " | Ni = 12 Co = 0.05 | 20 | 90 |
| 22 | " | " | " | " | Ni = 12, Cr = 3 | 20 | 105 |

| Run No. | Crack Density (regions/mm²) | Ratio of cracks <0.5 μm in width (%) | Ratio of cracks 80% or more deeper of the depth of plating layer (%) | Fuel Corrosion Resistance: Gasoline | Fuel Corrosion Resistance: Gasohol | Cosmetic Corrosion Resistance | Weldability | ** |
|---|---|---|---|---|---|---|---|---|
| 1 | 8000 | 90 | 95 | Δ | Δ | Δ | ○ | B |
| 2 | 2400 | 100 | 85 | ◎ | ◎ | ◎ | ○ | A |
| 3 | 2000 | 100 | 100 | ◎ | ◎ | ◎ | ○ | A |
| 4 | 5500 | 95 | 100 | ◎ | ◎ | ◎ | ○ | A |
| 5 | 4800 | 100 | 90 | ◎ | ◎ | x | ○ | B |
| 6 | 3600 | 100 | 95 | ◎ | ◎ | ◎ | ○ | A |
| 7 | 4300 | 95 | 90 | Δ | Δ | Δ | ○ | B |
| 8 | 4700 | 100 | 95 | ◎ | ◎ | ◎ | ○ | A |
| 9 | 3400 | 100 | 90 | ◎ | ◎ | ◎ | ○ | A |
| 10 | 7700 | 90 | 90 | ◎ | ◎ | ◎ | ○ | A |
| 11 | 4400 | 100 | 90 | ◎ | ◎ | ◎ | ○ | A |
| 12 | 6200 | 100 | 90 | ◎ | ◎ | ◎ | ○ | A |
| 13 | 1600 | 100 | 90 | ◎ | ◎ | ◎ | ○ | A |
| 14 | 4500 | 98 | 95 | ◎ | ◎ | ◎ | ○ | A |
| 15 | 5200 | 97 | 93 | ◎ | ◎ | ◎ | ○ | A |
| 16 | 4700 | 99 | 94 | ◎ | ◎ | ◎ | ○ | A |
| 17 | 5000 | 96 | 89 | ◎ | ◎ | ◎ | ○ | A |

TABLE 4-continued

| | | | | | | | | |
|---|---|---|---|---|---|---|---|---|
| 18 | 5100 | 98 | 90 | ◎ | ◎ | ◎ | ○ | A |
| 19 | 4600 | 99 | 91 | ◎ | ◎ | ◎ | ○ | A |
| 20 | 4800 | 100 | 93 | ◎ | ◎ | ◎ | ○ | A |
| 21 | 4500 | 98 | 92 | ◎ | ◎ | ◎ | ○ | A |
| 22 | 5100 | 98 | 85 | ◎ | ◎ | ◎ | ○ | A |

(Note)
*: outside the range of the present invention
**: Remarks
A: present invention
B: comparative

TABLE 5

| | Pre-plating layer (first layer) | | | | Plating layer (second layer) | | Chromate |
|---|---|---|---|---|---|---|---|
| Run No. | Plating Method | Ni Content (%) | Others | Amount ($g/m^2$) | Composition (X) (%) (Zn = 100 − X %) | Amount ($g/m^2$) | Amount ($mg/m^2$) |
| 23 | electrolytic | 95 | Fe, Zn | 0.5 | Ni = 13<br>Co = 0.05<br>Mn = 1, Cr = 2 | 20 | 110 |
| 24 | " | " | " | " | Co = 0.3 | 19 | 120 |
| 25 | " | " | " | " | Co = 0.5 | 19 | 120 |
| 26 | " | " | " | " | Co = 0.5<br>Mn = 25 | 19 | 120 |
| 27 | " | " | " | " | Co = 0.5<br>Cr = 8 | 19 | 120 |
| 28 | " | " | " | " | Mn = 35 | 18 | 130 |
| 29 | " | " | " | " | Mn = 35 | 18 | 130 |
| 30 | " | " | " | " | Mn = 35, Cr = 3 | 18 | 125 |
| 31 | " | " | " | " | Cr = 14 | 19 | 135 |
| 32 | " | " | " | " | Cr = 14 | 19 | 135 |
| 33 | " | " | " | " | Ni = 13 | 3* | 80 |
| 34 | " | " | " | " | Ni = 13 | 55* | 80 |
| 35 | " | " | " | " | Ni = 13 | 20 | 8* |
| 36 | " | " | " | " | Ni = 13 | 20 | 250* |
| 37 | " | " | " | " | Ni = 13 | 20 | 80 |
| 38 | " | " | " | " | Ni = 13 | 20 | 80 |
| 39 | " | " | " | " | Ni = 13 | 20 | 80 |
| 40 | " | " | " | " | Ni = 13 | 20 | 80 |

| Run No. | Crack Density (regions/ $mm^2$) | Ratio of cracks <0.5 μm in width (%) | Ratio of cracks 80% or more deeper of the depth of plating layer (%) | Fuel Corrosion Resistance: Gasoline | Fuel Corrosion Resistance: Gasohol | Cosmetic Corrosion Resistance | Weldability | ** |
|---|---|---|---|---|---|---|---|---|
| 23 | 4900 | 95 | 80 | ◎ | ◎ | ◎ | ○ | A |
| 24 | 5100 | 100 | 95 | ◎ | ◎ | ◎ | ○ | A |
| 25 | 550* | 75* | 65* | x | x | x | ○ | B |
| 26 | 5000 | 97 | 94 | ◎ | ◎ | ◎ | ○ | A |
| 27 | 4800 | 95 | 86 | ◎ | ◎ | ◎ | ○ | A |
| 28 | 8300 | 100 | 88 | ◎ | ◎ | ◎ | ○ | A |
| 29 | 160000* | 98 | 50* | x | x | x | x | B |
| 30 | 4000 | 98 | 90 | ◎ | ◎ | ◎ | ○ | A |
| 31 | 3500 | 95 | 91 | ◎ | ◎ | ◎ | ○ | A |
| 32 | 900* | 85* | 60* | x | x | x | ○ | B |
| 33 | 4300 | 100 | 90 | x | x | ○ | ○ | B |
| 34 | 4300 | 100 | 90 | ◎ | ◎ | x | ○ | B |
| 35 | 4300 | 100 | 90 | x | x | x | ○ | B |
| 36 | 4300 | 100 | 90 | Δ | Δ | ○ | x | B |
| 37 | 900* | 100 | 90 | Δ | Δ | x | ○ | B |
| 38 | 160000* | 100 | 90 | x | x | ○ | ○ | B |
| 39 | 4300 | 80* | 80 | Δ | Δ | Δ | ○ | B |
| 40 | 4300 | 100 | 70* | Δ | Δ | Δ | ○ | B |

(Note)
*: outside the range of the present invention
**: Remarks
A: present invention
B: comparative Example 5

In this example, Example 1 was repeated substantially in the same manner except that the amount of a Zn—X alloy electroplated layer in which cracks are formed is adjusted to be 7 g/m$^2$ or less, and a Zn plating which is electropotentially less noble than the Zn—X alloy layer is placed under the Zn—X alloy electroplated layer in an amount of 10–50 g/m$^2$.

The electroplating conditions were substantially the same as those of the Zn—X electroplating.

The composition of a chromate treatment solution employed in this example was as follows.

(Composition of Chromate Treatment Solution)

| | |
|---|---|
| $Cr^{3+}$ | 50 g/L |
| $Cr^{6+}$ | 2 g/L |
| $SiO_2$ | 180 g/L |

The results are shown in Table 6.

Example 6

In this example, Example 1 was repeated substantially in the same manner except that a thin Zn plating layer was placed on the Zn—X alloy electroplated layer in an amount of 7 g/m$^2$ or less. Cracks were introduced into this thin Zn plating layer for some of the samples, and cracks were not introduced for other samples. Properties of the resulting steel sheets were determined.

The thin Zn plating layer comprised a Zn—Y alloy (Y: Ni, Co, Mn, Cr) plating layer. The plating conditions were substantially the same as for the Zn—X alloy electroplating conditions.

The composition of a chromate treatment solution employed in this example was as follows.

TABLE 6

| | Under layer plating | | Upper layer plating | | | | | | | | | |
|---|---|---|---|---|---|---|---|---|---|---|---|---|
| | | | Composition (X) (%) | | Crack Density | Ratio of cracks <0.5 μm | Chromate | Fuel Corrosion Resistance | | Cosmetic | | |
| Run No. | Composition | Amount (g/m$^2$) | Amount (Zn = 100 − X %) | Amount (g/m$^2$) | (regions/ mm$^2$) | in width (%) | Amount (mg/m$^2$) | Gasoline | Gasohol | Corrosion Resistance | Weldability | Remarks |
| 1 | Zn = 100 | 20 | Ni = 9 | 5 | 4300 | 100 | 80 | ◎ | ◎ | ◎ | ○ | Invention |
| 2 | Zn = 100 | 19 | Ni = 11 | 5 | 500* | 80 | 100 | x | x | x | ○ | Comparative |
| 3 | Zn = 100 | 8* | Ni = 10 | 5 | 4000 | 90 | 110 | x | x | x | ○ | |
| 4 | Zn = 100 | 57* | Ni = 13 | 5 | 3700 | 95 | 100 | ◎ | ◎ | ○ | x | |
| 5 | Zn = 100 | 20 | Ni = 13 | 5 | 1800 | 85* | 98 | x | x | x | ○ | |
| 6 | Zn = 85, Fe = 15 | 21 | Ni = 18 | 4 | 5000 | 100 | 110 | ◎ | ◎ | ◎ | ○ | Invention |
| 7 | Zn = 100 | 20 | Ni = 12, Co = 0.05 | 4 | 4500 | 98 | 90 | ◎ | ◎ | ◎ | ○ | |
| 8 | Zn = 100 | 20 | Ni = 12, Mn = 3 | 4 | 5000 | 95 | 105 | ◎ | ◎ | ◎ | ○ | |
| 9 | Zn = 100 | 20 | Ni = 12, Cr = 2 | 4 | 5100 | 98 | 105 | ◎ | ◎ | ◎ | ○ | |
| 10 | Zn = 100 | 20 | Ni = 13, Co = 0.05 Mn = 2, Cr = 2 | 5 | 4900 | 95 | 110 | ◎ | ◎ | ◎ | ○ | |
| 11 | Zn = 100 | 19 | Co = 0.02 | 5 | 5100 | 100 | 120 | ◎ | ◎ | ◎ | ○ | |
| 12 | Zn = 100 | 19 | Co = 0.03 | 5 | 550* | 75* | 120 | x | x | x | ○ | Comparative |
| 13 | Zn = 85, Fe = 15 | 19 | Co = 0.5 | 5 | 5500 | 95 | 105 | ◎ | ◎ | ◎ | ○ | Invention |
| 14 | Zn = 100 | 19 | Co = 0.5, Mn = 4 | 4 | 5000 | 97 | 120 | ◎ | ◎ | ◎ | ○ | |
| 15 | Zn = 100 | 19 | Co = 0.5, Cr = 3 | 4 | 4800 | 95 | 120 | ◎ | ◎ | ◎ | ○ | |
| 16 | Zn = 100 | 18 | Mn = 45 | 5 | 8300 | 100 | 130 | ◎ | ◎ | ◎ | ○ | |
| 17 | Zn = 100 | 19 | Mn = 35, Cr = 4 | 5 | 4000 | 98 | 110 | ◎ | ◎ | ◎ | ○ | |
| 18 | Zn = 100 | 20 | Cr = 8 | 4 | 3500 | 95 | 100 | ◎ | ◎ | ◎ | ○ | |
| 19 | Zn = 100 | 21 | Cr = 14 | 4 | 900 | 85* | 105 | x | x | x | ○ | Comparative |
| 20 | Zn = 100 | 18 | Cr = 18 | 5 | 5200 | 95 | 80 | ◎ | ◎ | ◎ | ○ | Invention |
| 21 | Zn = 100 | 19 | Cr = 20 | 4 | 3800 | 95 | 100 | ◎ | ◎ | ◎ | ○ | |
| 22 | Zn = 100 | 20 | Co = 3 | 4 | 6700 | 100 | 120 | ◎ | ◎ | ◎ | ○ | |
| 23 | Zn = 100 | 18 | Mn = 25 | 5 | 9100 | 95 | 130 | ◎ | ◎ | ◎ | ○ | |
| 24 | Zn = 100 | 20 | Ni = 3 | 5 | 4000 | 98 | 130 | ◎ | ◎ | ◎ | ○ | |

(Note)
*: outside the range of the present invention (Composition of Chromate Treatment Solution)

| | |
|---|---|
| $Cr^{3+}$ | 30 g/L |
| $Cr^{6+}$ | 2 g/L |
| $SiO_2$ | 70 g/L |

The results are shown in Tables 7 and 8.

TABLE 7

| Run No. | Zn - X Plating: Substrate Plating (X) (%) (Zn = 100 − X %) | Zn - X Plating: Amount (g/m²) | Zn - X Plating: Crack Density (regions/mm²) | Zn - X Plating: Ratio of cracks <0.5 μm in width (%) | Zn - X Plating: Ratio of cracks 80% or more deeper of the depth of plating layer (%) | Zn - Y Plating: Zn - Y Plating Y (%) | Zn - Y Plating: Amount (g/m²) | Chromate Amount (mg/m²) | Fuel Corrosion Resistance: Gasoline | Fuel Corrosion Resistance: Gasohol | Cosmetic Corrosion Resistance | Weldability | ** |
|---|---|---|---|---|---|---|---|---|---|---|---|---|---|
| 1 | Ni = 9 | 20 | 4300 | 100 | 95 | Ni = 13 | 5 | 80 | ◎ | ◎ | ◎ | ○ | A |
| 2 | Ni = 9 | 21 | 5000 | 100 | 80 | Zn = 100 | 3 | 110 | ○ | ○ | ◎ | ○ | |
| 3 | Ni = 13 | 19 | 500* | 80* | 80 | Ni = 13 | 5 | 100 | x | x | x | ○ | B |
| 4 | Ni = 12, Co = 0.05 | 20 | 4500 | 98 | 90 | Ni = 12, Co = 0.05 | 4 | 90 | ◎ | ◎ | ◎ | ○ | A |
| 5 | Ni = 12, Co = 0.05 | 21 | 5200 | 96 | 95 | Ni = 13 | 4 | 115 | ◎ | ◎ | ◎ | ○ | |
| 6 | Ni = 12, Mn = 3 | 20 | 5000 | 95 | 95 | Ni = 13 | 5 | 105 | ◎ | ◎ | ◎ | ○ | |
| 7 | Ni = 12, Cr = 4 | 20 | 5100 | 98 | 90 | Ni = 14 | 3 | 105 | ◎ | ◎ | ◎ | ○ | |
| 8 | Ni = 13, Co = 0.05 Mn = 3, Cr = 1 | 20 | 4900 | 95 | 90 | Ni = 11 | 4 | 110 | ◎ | ◎ | ◎ | ○ | |
| 9 | Co = 0.02 | 19 | 5100 | 100 | 90 | Co = 0.3 | 5 | 110 | ◎ | ◎ | ◎ | ○ | |
| 10 | Co = 0.05 | 19 | 550* | 75* | 95 | Co = 0.3 | 5 | 105 | x | x | x | ○ | B |
| 11 | Co = 0.5, Mn = 3 | 19 | 5000 | 97 | 85 | Co = 0.5 | 4 | 120 | ◎ | ◎ | ◎ | ○ | A |
| 12 | Co = 0.5, Cr = 3 | 19 | 4800 | 95 | 90 | Co = 0.5 | 5 | 120 | ◎ | ◎ | ◎ | ○ | |
| 13 | Mn = 45 | 18 | 8300 | 100 | 90 | Mn = 35 | 5 | 130 | ◎ | ◎ | ◎ | ○ | |
| 14 | Mn = 40 | 18 | 160000* | 98 | 95 | Mn = 35 | 4 | 130 | x | x | x | x | B |
| 15 | Mn = 35, Cr = 4 | 18 | 4000 | 98 | 95 | Mn = 35 | 5 | 125 | ○ | ○ | ◎ | ○ | A |
| 16 | Cr = 8 | 19 | 3500 | 95 | 95 | Cr = 14 | 3 | 135 | ◎ | ◎ | ◎ | ○ | |
| 17 | Cr = 9 | 19 | 900* | 85* | 85 | Cr = 14 | 3 | 135 | x | x | x | ○ | B |
| 18 | Cr = 20 | 18 | 2000 | 95 | 90 | Cr = 11 | 3 | 135 | ◎ | ◎ | ◎ | ○ | A |
| 19 | Mn = 25 | 19 | 3500 | 90 | 90 | Mn = 30 | 5 | 130 | ◎ | ◎ | ◎ | ○ | |
| 20 | Ni = 18 | 18 | 1700 | 95 | 85 | Ni = 10 | 4 | 80 | ◎ | ◎ | ◎ | ○ | |
| 21 | Co = 3 | 20 | 137000 | 95 | 95 | Co = 0.5 | 5 | 110 | ◎ | ◎ | ◎ | ○ | |
| 22 | Ni = 10 | 19 | 8200 | 95 | 70* | Ni = 12 | 3 | 110 | ○ | ○ | Δ | ○ | B |
| 23 | Ni = 11, Cr = 2 | 19 | 11200 | 90 | 75* | Ni = 14 | 4 | 95 | Δ | ○ | ○ | ○ | |
| 24 | Co = 0.07 | 20 | 4200 | 95 | 70* | Co = 0.3 | 4 | 100 | Δ | ○ | Δ | ○ | |
| 25 | Mn = 40 | 20 | 38500 | 95 | 70* | Mn = 35 | 5 | 110 | Δ | Δ | Δ | ○ | |
| 26 | Cr = 10 | 18 | 49300 | 90 | 75* | Cr = 13 | 4 | 110 | Δ | Δ | Δ | ○ | |
| 27 | Ni = 3 | 20 | 4300 | 95 | 90 | Ni = 13 | 5 | 120 | ◎ | ◎ | ◎ | ○ | A |

(Note)

*: outside the range of the present invention

**Remarks

A: present invention

B: comparative

TABLE 8

| Run No. | Zn - X Plating: Substrate Plating (X) (%) (Zn = 100 − X %) | Amount ($g/m^2$) | Crack Density (regions/$mm^2$) | Ratio of cracks <0.5 μm in width (%) | Ratio of cracks 80% or more deeper of the depth of plating layer (%) | Zn - Y Plating: Zn - Y Plating Y (%) | Amount ($g/m^2$) | Crack Density (regions/$mm^2$) | Ratio of cracks <0.5 μm in width (%) |
|---|---|---|---|---|---|---|---|---|---|
| 1 | Ni = 9 | 20 | 4300 | 100 | 95 | Ni = 13 | 5 | 3000 | 90 |
| 2 | Ni = 9 | 18 | 500* | 80* | 80 | Ni = 13 | 5 | 2500 | 90 |
| 3 | Ni = 12<br>Co = 0.05 | 20 | 4500 | 98 | 90 | Ni = 12<br>Co = 0.05 | 4 | 5000 | 95 |
| 4 | Co = 0.02 | 19 | 5100 | 100 | 90 | Co = 0.3 | 5 | 6000 | 85 |
| 5 | Co = 0.05 | 19 | 550* | 75* | 95 | Co = 0.3 | 5 | 3000 | 90 |
| 6 | Mn = 45 | 18 | 8300 | 100 | 90 | Mn = 35 | 5 | 9000 | 90 |
| 7 | Mn = 40 | 18 | 160000* | 98 | 95 | Mn = 35 | 4 | 165000 | 85 |
| 8 | Cr = 8 | 19 | 3500 | 95 | 95 | Cr = 11 | 3 | 5500 | 90 |
| 9 | Cr = 9 | 19 | 900* | 85* | 85 | Cr = 10 | 3 | 5500 | 95 |
| 10 | Cr = 20 | 18 | 2000 | 95 | 90 | Cr = 14 | 3 | 5500 | 95 |
| 11 | Mn = 25 | 19 | 3500 | 90 | 90 | Mn = 30 | 5 | 9000 | 90 |
| 12 | Ni = 18 | 18 | 1700 | 92 | 85 | Ni = 12 | 4 | 3000 | 95 |
| 13 | Co = 3 | 20 | 137000 | 95 | 95 | Co = 0.4 | 5 | 136000 | 95 |
| 14 | Ni = 10 | 19 | 8200 | 95 | 70* | Ni = 12 | 3 | 4200 | 90 |
| 15 | Ni = 11,<br>Cr = 2 | 19 | 11200 | 90 | 75* | Ni = 14 | 4 | 6400 | 90 |
| 16 | Co = 0.07 | 20 | 4200 | 95 | 70* | Co = 0.3 | 4 | 3200 | 95 |
| 17 | Mn = 40 | 20 | 38500 | 95 | 70* | Mn = 35 | 5 | 5700 | 90 |
| 18 | Cr = 10 | 18 | 49300 | 90 | 75* | Cr = 13 | 4 | 6100 | 95 |
| 19 | Ni = 3 | 19 | 3500 | 100 | 90 | Ni = 12 | 4 | 3000 | 95 |

| Run No. | Chromate Amount ($mg/m^2$) | Fuel Corrosion Resistance: Gasoline | Fuel Corrosion Resistance: Gasohol | Cosmetic Corrosion Resistance | Weldability | ** |
|---|---|---|---|---|---|---|
| 1 | 80 | ◎ | ◎ | ◎ | ○ | A |
| 2 | 100 | x | x | x | ○ | B |
| 3 | 90 | ◎ | ◎ | ◎ | ○ | A |
| 4 | 120 | ◎ | ◎ | ◎ | ○ | |
| 5 | 120 | x | x | x | ○ | B |
| 6 | 130 | ◎ | ◎ | ◎ | ○ | A |
| 7 | 130 | x | x | x | x | B |
| 8 | 135 | ◎ | ◎ | ◎ | ○ | A |
| 9 | 135 | x | x | x | ○ | B |
| 10 | 130 | ◎ | ◎ | ◎ | ○ | A |
| 11 | 120 | ◎ | ◎ | ◎ | ○ | |
| 12 | 130 | ◎ | ◎ | ◎ | ○ | |
| 13 | 130 | ◎ | ◎ | ◎ | ○ | |
| 14 | 110 | ○ | ○ | Δ | ○ | B |
| 15 | 95 | Δ | ○ | ○ | ○ | |
| 16 | 100 | Δ | ○ | Δ | ○ | |
| 17 | 110 | Δ | Δ | Δ | ○ | |
| 18 | 110 | Δ | Δ | Δ | ○ | |
| 19 | 130 | ◎ | ◎ | ◎ | ○ | A |

(Note)
*: outside of the range of the present invention
**Remarks
A: present invention
B: comparative

Example 7

In this example, Example 1 was repeated substantially in the same manner except that a thin resin coating was placed on the chromate film.

The composition of a chromate treatment solution employed in this example was as follows.

(Composition of Chromate Treatment Solution)

| | |
|---|---|
| $Cr^{3+}$ | 50 g/L |
| $Cr^{6+}$ | 2 g/L |

After processed of the steel sheet with the chromate treatment solution, a thin resin coating was applied to the thus-prepared chromate film. The resin coating comprised acrylic, epoxy, or urethane resin together with silica combined as an organic pigment, and the coating was applied in a thickness of 1 μm.

The results are shown in Table 9.

TABLE 9

| Run No. | Substrate Plating (X) (%) (Zn = 100 − X %) | Plating Amount ($g/m^2$) | Chromate Amount ($mg/m^2$) | Crack Density (regions/ $mm^2$) | Ratio of cracks <0.5 μm in width (%) | Ratio of cracks 80% or more deeper of the depth of plating layer (%) | Resin Coating | Fuel Corrosion Resistance Gasoline | Fuel Corrosion Resistance Gasohol | Cosmetic Corrosion Resistance | Weldability | ** |
|---|---|---|---|---|---|---|---|---|---|---|---|---|
| 1 | Ni = 9 | 20 | 80 | 4300 | 100 | 90 | Acrylic | ◎ | ◎ | ◎ | ○ | A |
| 2 | Ni = 9 | 19 | 100 | 500* | 80* | 70* | Acrylic | x | x | x | ○ | B |
| 3 | Ni = 10 | 20 | 98 | 1800 | 85* | 80 | Acrylic | x | x | x | ○ | B |
| 4 | Ni = 12, Co = 0.05 | 20 | 90 | 4500 | 98 | 92 | Epoxy | ◎ | ◎ | ◎ | ○ | A |
| 5 | Ni = 12, Mn = 3 | 20 | 105 | 5000 | 95 | 90 | Polyester | ◎ | ◎ | ◎ | ○ | A |
| 6 | Ni = 12, Cr = 2 | 20 | 105 | 5100 | 98 | 85 | Uarethane | ◎ | ◎ | ◎ | ○ | A |
| 7 | Ni = 13, Co = 0.05 Mn = 3, Cr = 1 | 20 | 110 | 4900 | 95 | 89 | Acrylic | ◎ | ◎ | ◎ | ○ | A |
| 8 | Co = 0.02 | 19 | 120 | 5100 | 100 | 95 | Epoxy | ◎ | ◎ | ◎ | ○ | A |
| 9 | Co = 0.05 | 19 | 120 | 550* | 75* | 65* | Epoxy | x | x | x | ○ | B |
| 10 | Co = 0.5, Mn = 4 | 19 | 120 | 5000 | 97 | 94 | Epoxy | ◎ | ◎ | ◎ | ○ | A |
| 11 | Co = 0.5, Cr = 3 | 19 | 120 | 4800 | 95 | 86 | Epoxy | ◎ | ◎ | ◎ | ○ | A |
| 12 | Mn = 45 | 18 | 130 | 8300 | 100 | 88 | Acrylic | ◎ | ◎ | ◎ | ○ | A |
| 13 | Mn = 40 | 18 | 130 | 16000 | 98 | 50* | Epoxy | x | x | x | x | B |
| 14 | Mn = 35, Cr = 4 | 18 | 125 | 4000 | 98 | 85 | Epoxy | ◎ | ◎ | ◎ | ○ | A |
| 15 | Cr = 8 | 19 | 135 | 3500 | 95 | 95 | Epoxy | ◎ | ◎ | ◎ | ○ | A |
| 16 | Cr = 10 | 19 | 135 | 900* | 85* | 90 | Epoxy | x | x | x | ○ | B |
| 17 | Cr = 15 | 19 | 135 | 4000 | 94 | 60* | None* | x | x | x | ○ | B |
| 18 | Cr = 20 | 18 | 130 | 6100 | 95 | 95 | Epoxy | ◎ | ◎ | ◎ | ○ | A |
| 19 | Mn = 25 | 19 | 120 | 7000 | 90 | 90 | Acrylic | ◎ | ◎ | ◎ | ○ | A |
| 20 | Co = 3 | 20 | 130 | 3700 | 90 | 95 | Epoxy | ◎ | ◎ | ◎ | ○ | A |
| 21 | Ni = 18 | 18 | 130 | 1700 | 95 | 85 | Acrylic | ◎ | ◎ | ◎ | ○ | A |
| 22 | Ni = 3 | 20 | 105 | 4000 | 100 | 100 | Acrylic | ◎ | ◎ | ◎ | ○ | A |

(Note)
*: outside of the range of the present invention
**Remarks
A: present invention
B: comparative

Example 8

In this example, Example 1 was repeated substantially in the same manner except that a lubricating agent was incorporated in the chromate film.

The lubricant was an amine, acrylic, or epoxy resin. The acrylic resin was that commercially available under tradename "P304M2" from Nihon Paint Co., Ltd., and the epoxy resin was that commercially available under tradename "Denacast" from Nagase Chemicals.

(Composition of Chromate Treatment Solution)

| | |
|---|---|
| $Cr^{3+}$ | 50 g/L |
| $Cr^{6+}$ | 2 g/L |
| $SiO_2$ | 140 g/L |

The results are shown in Table 10.

TABLE 10

| Run No. | Substrate Plating (X) (%) (Zn = 100 − X %) | Plating Amount ($g/m^2$) | Crack Density (regions/ $mm^2$) | Ratio of cracks <0.5 μm in width (%) | Ratio of cracks 80% or more deeper of the depth of plating layer (%) | Chromate Amount ($mg/m^2$) | Type of Resin in chromate | Fuel Corrosion Resistance Gasoline | Fuel Corrosion Resistance Gasohol | Cosmetic Corrosion Resistance | Weldability | ** |
|---|---|---|---|---|---|---|---|---|---|---|---|---|
| 1 | Ni = 9 | 20 | 4300 | 100 | 90 | 80 | Acrylic | ◎ | ◎ | ○ | ○ | A |
| 2 | Ni = 9 | 19 | 500* | 80* | 70* | 100 | None | x | x | x | ○ | B |

TABLE 10-continued

| Run No. | Substrate Plating (X) (%) (Zn = 100 − X %) | Plating Amount ($g/m^2$) | Crack Density (regions/ $mm^2$) | Ratio of cracks <0.5 μm in width (%) | Ratio of cracks 80% or more deeper of the depth of plating layer (%) | Chromate Amount ($mg/m^2$) | Type of Resin in chromate | Fuel Corrosion Resistance Gasoline | Fuel Corrosion Resistance Gasohol | Cosmetic Corrosion Resistance | Weldability | ** |
|---|---|---|---|---|---|---|---|---|---|---|---|---|
| 3 | Ni = 13 | 20 | 1800 | 85* | 80 | 98 | None | Δ | Δ | x | ○ | |
| 4 | Ni = 12, Co = 0.05 | 20 | 4500 | 98 | 92 | 90 | Acrylic | ◎ | ◎ | ◎ | ○ | A |
| 5 | Ni = 12, Mn = 3 | 20 | 5000 | 95 | 90 | 105 | Epoxy | ◎ | ◎ | ◎ | ○ | |
| 6 | Ni = 12, Cr = 2 | 20 | 5100 | 98 | 85 | 105 | Epoxy | ◎ | ◎ | ◎ | ○ | |
| 7 | Ni = 13, Co = 0.05 Mn = 3, Cr = 1 | 20 | 4900 | 95 | 98 | 110 | Acrylic | ◎ | ◎ | ◎ | ○ | |
| 8 | Co = 0.02 | 19 | 5100 | 100 | 95 | 120 | Acrylic | ◎ | ◎ | ◎ | ○ | |
| 9 | Co = 0.05 | 19 | 550* | 75* | 65* | 120 | Acrylic | x | x | x | ○ | B |
| 10 | Co = 0.5, Mn = 4 | 19 | 5000 | 97 | 94 | 120 | Amine | ◎ | ◎ | ◎ | ○ | A |
| 11 | Co = 0.5, Cr = 3 | 19 | 4800 | 95 | 86 | 120 | Amine | ◎ | ◎ | ◎ | ○ | |
| 12 | Mn = 45 | 18 | 8300 | 100 | 88 | 130 | Acrylic | ◎ | ◎ | ◎ | ○ | |
| 13 | Mn = 40 | 18 | 160000* | 98 | 50* | 130 | None | x | x | x | x | B |
| 14 | Mn = 35, Cr = 4 | 18 | 4000 | 98 | 90 | 125 | Acrylic | ◎ | ◎ | ◎ | ○ | A |
| 15 | Cr = 14 | 19 | 3500 | 95 | 91 | 135 | Acrylic | ◎ | ◎ | ◎ | ○ | |
| 16 | Cr = 14 | 19 | 900* | 85* | 60* | 135 | None | x | x | x | ○ | B |
| 17 | Cr = 20 | 18 | 2000 | 95 | 95 | 130 | Acrylic | ◎ | ◎ | ◎ | ○ | A |
| 18 | Mn = 25 | 19 | 3500 | 90 | 90 | 120 | Acrylic | ◎ | ◎ | ◎ | ○ | |
| 19 | Ni = 18 | 18 | 1700 | 95 | 95 | 130 | Acrylic | ◎ | ◎ | ◎ | ○ | |
| 20 | Co = 3 | 20 | 137000 | 95 | 85 | 130 | Acrylic | ◎ | ◎ | ◎ | ○ | |
| 21 | Ni = 3 | 20 | 4500 | 98 | 95 | 130 | Acrylic | ◎ | ◎ | ◎ | ○ | |

(Note)
*: outside of the range of the present invention
**: Remarks
A: present invention
B: comparative (Industrial Applicability)

A surface-treated steel sheet of the present inventions when used for manufacturing fuel tanks, can exhibit improved fuel resistance to not only gasoline but also to alcohol-containing fuels such as gasohol, and the surface-treated steel sheet can be manufactured with a conventional Zn—X alloy electrodepositing apparatus efficiently and economically. Furthermore, since the steel sheet is free from Pb which is harmful to the human body, the surface-treated steel sheet of the present invention does not cause health problems.

What is claimed is:

1. A surface-treated steel sheet exhibiting improved corrosion resistance after forming, which comprises a Zn—X alloy electroplated layer in an amount of 5–50 $g/m^2$ on at least one side of the steel sheet, an alloy composition of the layer being such that X is at least one substance selected from the group consisting of Ni: 3–18 wt %, Co: 0.02–3 wt %, Mn: 25–45 wt %, and Cr: 8–20 wt %, and a chromate film placed on the Zn—X alloy electroplated layer in an amount of 10–200 $mg/m^2$ as metallic Cr, the Zn—X alloy plating layer having cracks, the density of which is 1000–150000 in terms of the number of plated regions surrounded by cracks in a visual field measuring 1 mm×1 mm, with cracks having a maximum width of 0.5 μm or less comprising 90% or more of the total number of the cracks, and with cracks having a depth of 80 % or more of the thickness of the plating layer comprising 80% or more of the total number of the cracks.

2. A surface-treated steel sheet as set forth in claim 1 wherein a plating layer containing 70 wt % or more of Ni is placed in an amount of 0.001–5 $g/m^2$ underneath the Zn—X alloy plating layer.

3. A surface-treated steel sheet as set forth in claim 1 wherein a Zn plating layer in an amount of 7 $g/m^2$ or less is placed on the Zn—Ni alloy electroplated layer, and the chromate film is placed on the Zn plating layer.

4. A surface-treated steel sheet as set forth in claim 3 wherein cracks are provided in the Zn plating layer.

5. A surface-treated steel sheet as set forth in claim 1 wherein a thin resin coating is applied to the chromate film.

6. A surface-treated steel sheet as set forth in claim 1 wherein the chromate film contains a lubricating agent.

7. A surface-treated steel sheet exhibiting improved corrosion resistance after forming, which comprises a Zn—X alloy electroplated layer in an amount of 7 $g/m^2$ or less on at least one side of the steel sheet, an alloy composition of the layer being such that X is at least one substance selected from the group consisting of Ni: 3–18 wt %, Co: 0.02–3 wt %, Mn: 25–45 wt %, and Cr: 8–20 wt %, a Zn plating layer in an amount of 10–50 $g/m^2$ which is plated as an underlayer of the Zn—X alloy electroplated layer and which is less noble potential than the Zn—X alloy electroplated layer, and a chromate film placed on the Zn—X alloy electroplated layer in an amount of 10–200 mg/m$^2$ as metallic Cr, the Zn—X alloy plating layer underlying the chromate film having cracks with a density of 1000–150000 in terms of the number of plated regions surrounded by cracks in a visual field measuring 1 mm×1 mm, with cracks having a maximum width of 0.5 $\mu$m or less comprising 90% or more of the total number of the cracks.

8. A surface-treated steel sheet as set forth in claim 7 wherein a plating layer containing 70 wt % or more of Ni is placed in an amount of 0.001–5 g/m$^2$ underneath the Zn—X alloy plating layer.

9. A surface-treated steel sheet as set forth in claim 7 wherein a thin resin coating is applied to the chromate film.

10. A surface-treated steel sheet as set forth in claim 7 wherein the chromate film contains a lubricating agent.

11. A surface-treated steel sheet as set forth in claim 1 wherein the chromate film penetrates at least some of the cracks in the Zn—X alloy plating layer.

12. A surface-treated steel sheet as set forth in claim 7 wherein the chromate film penetrates at least some of the cracks in the Zn—X alloy plating layer.

* * * * *